United States Patent [19]

Burnett

[11] 4,333,210

[45] * Jun. 8, 1982

[54] SEALING DEVICE

[75] Inventor: Ralph G. Burnett, Kenosha, Wis.

[73] Assignee: American Casting and Manufacturing Corporation, Plain View, N.Y.

[ * ] Notice: The portion of the term of this patent subsequent to Sep. 23, 1997, has been disclaimed.

[21] Appl. No.: 150,242

[22] Filed: May 15, 1980

[51] Int. Cl.[3] ..... B65D 27/30; B65D 77/10

[52] U.S. Cl. ..... 24/30.5 R; 24/30.5 P; 24/16 PB; 24/206 A; 24/20 TT; 292/325

[58] Field of Search ..... 24/30.5 R, 30.5 P, 16 PB, 24/206 A, 20 TT; 292/308, 317, 325, 320

[56] References Cited

U.S. PATENT DOCUMENTS

| | | | |
|---|---|---|---|
| 2,654,624 | 10/1953 | Canter et al. | 24/30.5 R |
| 2,761,720 | 9/1956 | Brooks | 292/317 |
| 2,977,145 | 3/1961 | Rifkin | 24/16 PB |
| 3,311,957 | 4/1967 | Dunn | 292/325 |
| 3,748,697 | 7/1973 | Marchese et al. | 24/20 TT |
| 4,223,424 | 9/1980 | Burnett | 24/30.5 R |

*Primary Examiner*—Victor N. Sakran

*Attorney, Agent, or Firm*—Allegretti, Newitt, Witcoff & McAndrews

[57] ABSTRACT

The invention is an improvement over my copending application Ser. No. 951,569 filed Oct. 15, 1978 now U.S. Pat. No. 4,223,423, granted Sept. 23, 1980, and relates to a sealing device, which is particularly useful with a receptacle, such as a cloth bank bag for containing money or currency. The sealing device comprises a single strip or band of material made of metal or plastic and formed with teeth or serrations, which extend from one side of the band and includes locking projections engaging with the teeth or serrations in an improved manner for securing the band in its closed position. The locking teeth are stamped, or otherwise formed in the material near one end of the band, so that the other end of the band may be inserted through slits in the band, whereby a number of teeth engage with locking elements when the band is tightened around the neck of the bag. Movement of the end of the band is thereby prevented in the direction which would unlock the seal but is freely permitted in the other direction for the extent of the teeth so that a tight seal may be accomplished. Once sealed, the sealing device cannot be released without tearing or mutilating the bag material or damaging the sealing device.

3 Claims, 9 Drawing Figures

SEALING DEVICE

BACKGROUND OF THE INVENTION

Heretofore, bank bags, which are usually formed of heavy cloth such as duck or denim for carrying money, currency or the like, have been provided with a seal around the open neck thereof so that access to the interior of the bag or receptacle cannot be obtained without breaking the seal. In this manner, it is immediately apparent whether or not the seal has been tampered with and the contents of the bag either removed therefrom or some material which is worthless has been substituted for the original contents of the bag. One such seal is shown, for example, in Canter et al U.S. Pat. No. 2,654,624.

It has been found that with careful manipulation, the former sealing devices used, which were usually formed of a soft material such as lead, which was tightened or deformed after strings were inserted through holes therein by a tool to restrain or hold the strings in place around the neck of the bag and which had teeth or points which would dig into the bag so that removal of the seal is difficult, did not always serve their intended purpose and were relatively expensive. One reason that they were unsatisfactory was because persons with sufficient patience and strength could carefully manipulate the seal so that it could be removed from the bag and the contents thereof either pilfered or changed and the seal could then be carefully replaced around the neck of the open end of the bag with no readily visible indication that the seal had been tampered with. In bank bags, this is a decided disadvantage because such bags at times contain valuable material sealed in the bags and the bags may not be opened for a considerable period of time. If pilferage or substitution is not discovered immediately it is difficult to trace the person or persons who tampered with the bag or to determine when or where the tampering took place. Furthermore, such seals were usually formed of materials which are relatively expensive, such as lead, for example, and required a special tool to secure them on the bag after the contents have been placed therein.

Other seal constructions which are usable with a cloth bag, for example, are shown in Rifkin, U.S. Pat. No. 2,977,145, and Marchese et al. U.S. Pat. No. 3,748,697. While these patents disclose seal constructions, formed of a band of resilient yieldable material with interlocking teeth to hold the yieldable material in position when tightened, the seals are readily accessible, which is obviously undesirable since they can be relatively easily broken externally of the sealing band.

Another seal construction is illustrated in my copending application Ser. No. 951,569, filed Oct. 15, 1978 for Bank Bag Sealer and is assigned to the assignee of the present application. As stated, the present invention is an improvement on the sealer shown in the application Ser. No. 951,569, which shows the sealer applied to a cloth bank bag.

The present invention provides an improvement and an inexpensive, foolproof sealing device particularly for bank bags and the like which cannot be removed from the bag without tearing or mutilating the bag material, whereby it is immediately apparent that the bag has been tampered with and the seal damaged. The purpose also is to provide a seal of the type wherein the only manner in which the seal may be removed from the bag is by cutting or severing the same with a cutting tool.

It is an object of the invention to provide a bag seal which is inexpensive and may be manufactured in large quantities very cheaply from metal stampings or molded plastic strips such as formed from materials known by the trademarks Nylon or Delrin.

The improvement concerns panel 26 and panel 28 as described in the foregoing application Ser. No. 951,569 and one of the teeth 20 which lies between the teeth 22 in FIG. 7 thereof. A third tooth, which has been marked as 15 in the present application now actively participates in the sealing action of the strip. Moreover, the improvement conceals tooth 15 and renders it inaccessible to anyone attempting to tamper with it.

SUMMARY OF THE INVENTION

The invention relates to a sealing device usable, for example, on bank bags or the like, which sealing device is formed from a band of material which circumferentially surrounds and tightly seals the open neck end of the bag when in place, and which will visually indicate improper attempts to remove the seal from the bag. The device is constructed so that no sharp edges or protruberances extend outward from the band after it has been secured, and also provides for additional locking security.

DESCRIPTION OF THE PREFERRED EMBODIMENT

Figure 1:
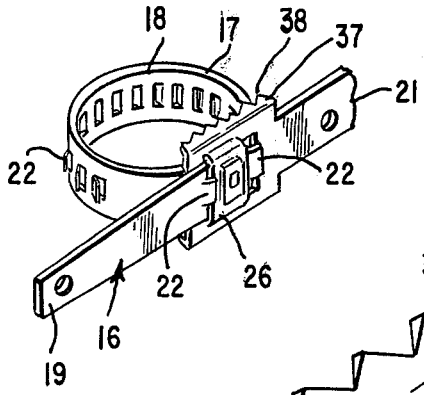
FIG. 1 is a perspective view of the sealer.
Figure 4:
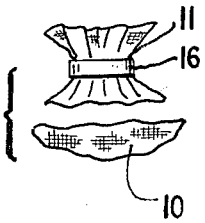
FIG. 4 is a small perspective view of a bank bag with the sealer secured thereto.
Figure 5:
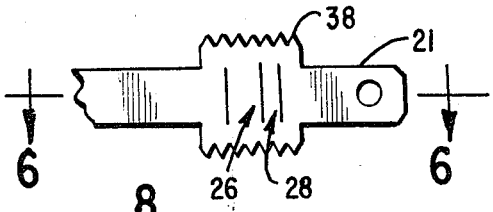
FIG. 5 is a plan view of a portion of the strip or sealer.
Figure 6:
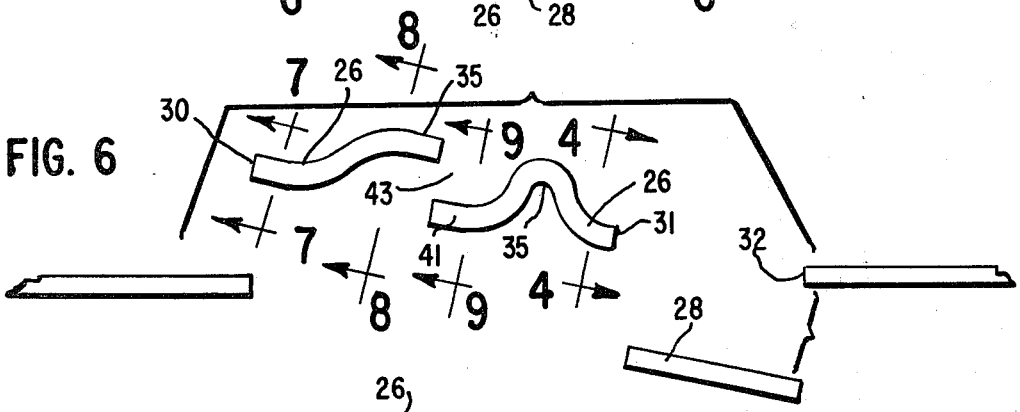
FIG. 6 is a longitudinal sectional view of FIG. 5 taken on line 6—6 thereof.

FIG. 1 is a perspective view of a sealer 16, which is formed by a strip 17 having a plurality of teeth or serrations 22 formed on portion 18 thereof and having opposite ends 19 and 21. The width of the elevated panel 26 has been increased with reference to applicant's copending application Ser. No. 951,569 and the width of the depressed panel 28 therein has been decreased when compared with FIGS. 4 and 9 of the drawing of that application. This has been done so that panel 26 is wide enough to more than cover tooth 15 completely. Panel 28 receives very little stress and can be reduced in width without losing its effectiveness.

As part of the improvement, a bubble or elevation 35 is stamped in panel 26 so as to produce a very shallow chamber in panel 26, which chamber or elevation is slightly elevated above the outside surface of panel 26. The purpose of the chamber defined by elevation 35 is to relieve any excess pressure on tooth 15, because tooth 15 will be covered by panel 26 when the sealer has been tightened in place on the bag. Excess pressure on tooth 15 could bend it toward the bag and decrease or nullify its spring-back action, which is essential to its function.

Figure 2:
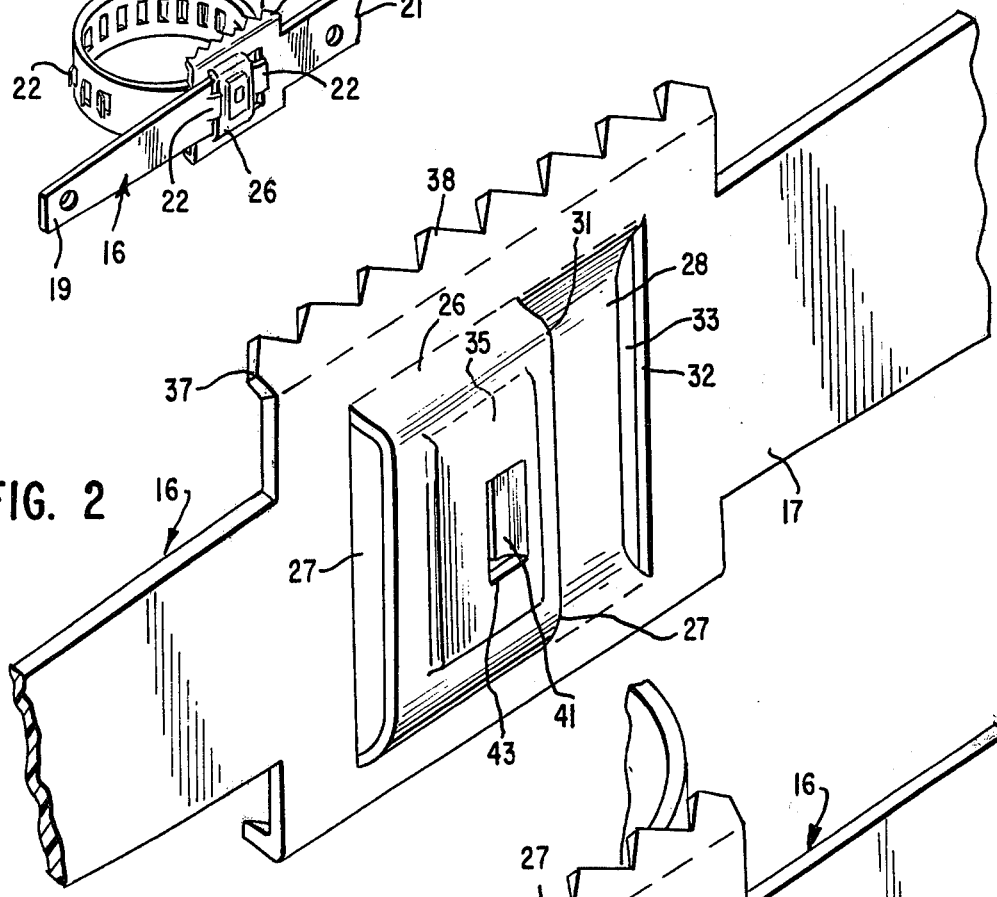
FIG. 2 is an enlarged perspective view of a portion of the body of the sealer.
Figure 3:
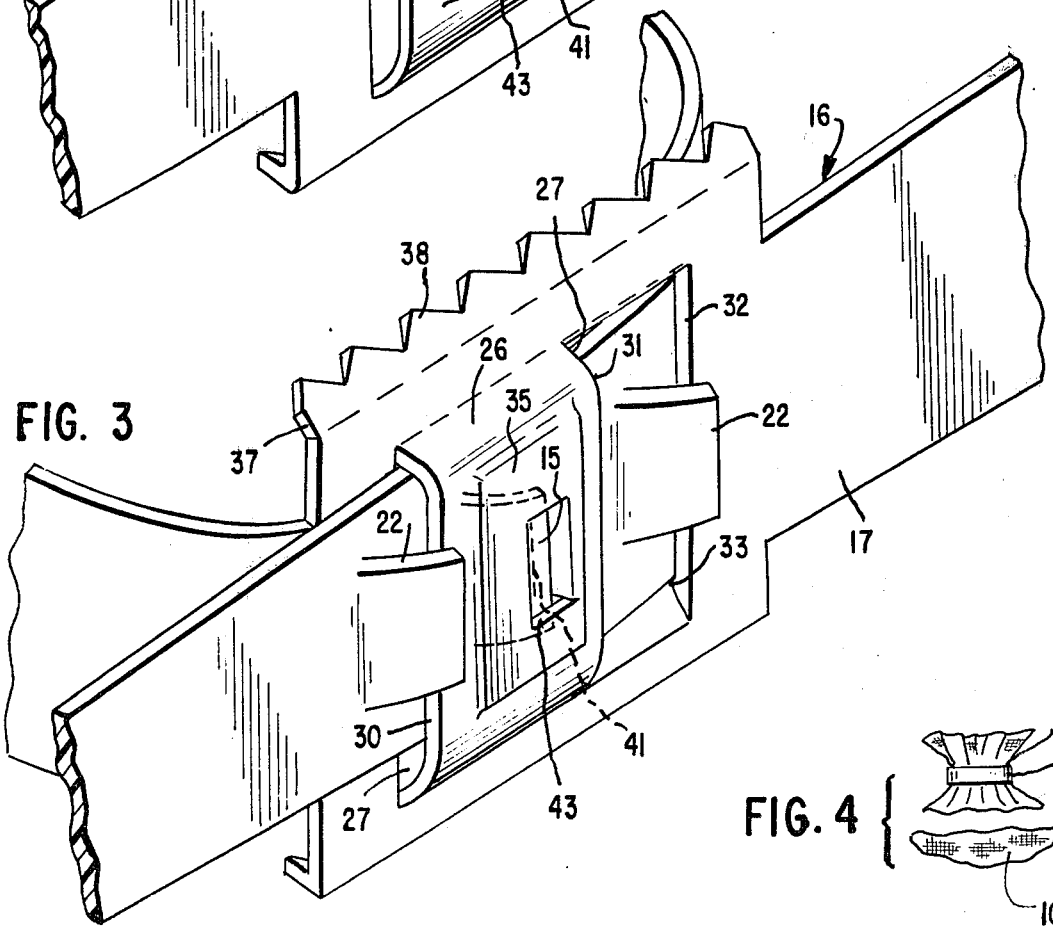
FIG. 3 is an enlarged perspective view of a portion of the sealer showing the assembled parts in their functioning position.
Figure 7:
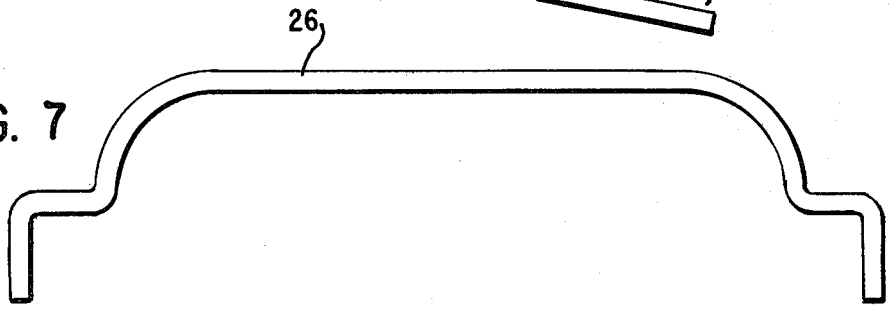
FIG. 7 is a transverse sectional view of FIG. 6 taken on line 7—7 thereof and also on line 4—4 thereof.
Figure 8:
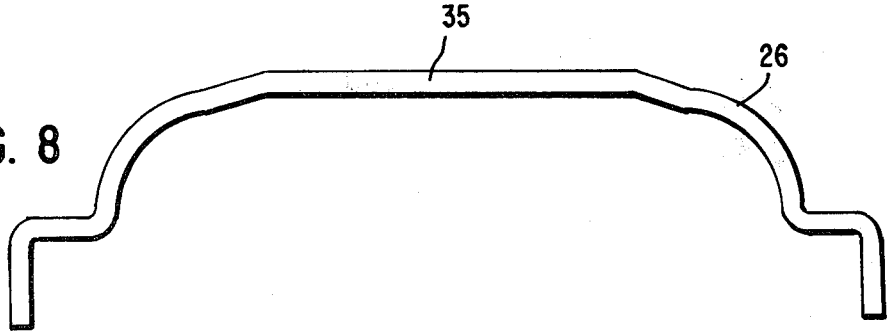
FIG. 8 is a transverse sectional view taken on line 8—8 of FIG. 6.

FIGS. 2 and 3 show that bubble or elevation 35 is elevated very slightly, for example, 0.010 inches above the level of panel 26. FIGS. 7 and 8 illustrate that the elevation 35 is sufficiently wide to more than accommodate the width of the tooth 15.

A feature of the improvement is window 43 stamped or otherwise formed in the surface of panel 26. The window 43 is more narrow than the teeth 15 and is close to the edge 31 in panel 26. Three of the borders of the window 43 are stamped through. The fourth border of the window 43 is adjacent to the edge 31 and is not stamped through.

Figure 9:
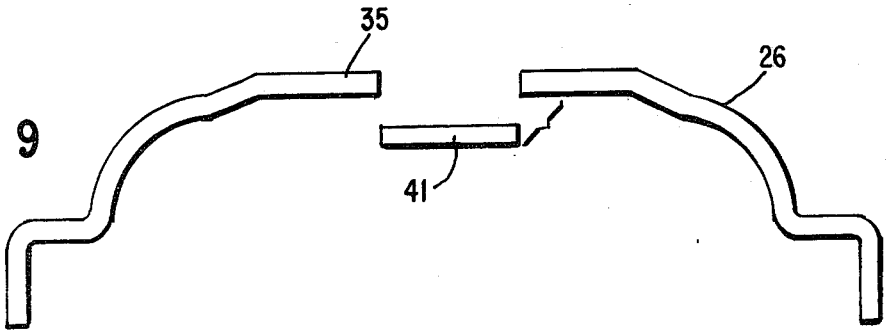
FIG. 9 is a transverse sectional view of FIG. 6 taken on line 9—9 thereof.

Another feature of the improvement is tooth 41 in panel 26. Tooth 41 is formed below the inside surface of panel 26 and the free edge of tooth 41 is to be directed in opposition to the free edges of the teeth 22. Tooth 41, which may be termed a reverse tooth, is continuous with the material of panel 26 at the border of window 43, which border is closest to edge 31. FIGS. 2 and 3 show that the tooth 41 is pressed down and below the inside surface of panel 26 so as to afford a clearance at approximately 0.015 inches, which is approximately 150% of the thickness of the stock. FIG. 9 shows the construction in a transverse sectional view.

FIG. 3 shows an enlarged perspective view of the sealer assembled and in its operative position to seal, with the teeth 22 cooperating with edges 30 and 32, as described more fully in Ser. No. 951,569. FIG. 3 also shows that the tooth 15 is interlocked with tooth 41, and that tooth 41 is directed opposite to the direction of tooth 15. Tooth 41 entraps tooth 15 between itself and the inner surface of panel 26. FIG. 3 also shows that only a portion of the edge of tooth 15 is visible through the window 43 because window 43 is not as wide as tooth 15. The corners of tooth 15 are covered and concealed by the material of panel 26 at each side of window 43.

Thus, tooth 15 is interlocked with tooth 41 and concealed and covered by the material of panel 26, except for that small portion visible through window 43. Also, tooth 15 is enclosed and entrapped by tooth 41 and the fabric of the bag on its inner surface and panel 26 on its outer surface. Tooth 15 is inaccessible to any person who attempts to tamper with it.

A transverse slot 33 is formed in strip 17 and a pair of transverse slots 27 are formed by panel 26 as best shown in FIGS. 2 and 3 for insertion of end 19 of strip 17 for assembly. Edge panels 37 are provided on sealer 16 with sharp projections or serrations 38 for engaging the cloth neck 11 of a bank bag 10 or other device, and are adapted to be bent inwardly after the assembly is stamped out or otherwise formed, as shown in FIG. 3. The projections 38 on the edge panels 37 comprise penetrating means for engaging firmly with the cloth or like material of bank bag 10 and preclude slipping the sealer 16 from the bank bag after it has been secured in place.

It is to be noted that the distances and measurements recited herein are calculations for one specific form of the invention and are subject to change depending upon the application of the sealer.

The present invention provides a bank bag sealer which is formed and is capable of securely closing a bank bag containing currency or the like valuables, relatively inexpensively, from a single piece of material. The sealer of the present invention may be manufactured relatively inexpensively on automatic machinery. The sealer is easy to use, and can be tightly secured to the bag with relatively little strength necessary on the part of the person applying the bank bag sealer. Furthermore, the present bank bag sealer is less expensive and stronger than prior art lead seals.

While I have disclosed a presently preferred embodiment of the invention, the invention is intended to be limited only by the scope of the appended claims.

I claim:

1. A sealing device for a receptacle having at least one open end, which receptacle consists at least in part of deformable material adjacent the open end thereof, so that the material may be gathered together to form a neck, said sealing device comprising a relatively thin band of flexible material which is of sufficient strength that it is manually severable only by cutting through the same, said band comprising an elongated flat body portion and a pair of end portions at the extremities thereof, means for tightly securing the body portion of said band circumferentially about the neck of said receptacle adjacent to said end, with said end portions extending outwardly from the circumferential body portion, means on said band for preventing the seal from being opened to gain access to said receptacle without severing or damaging the band, a plurality of projections formed on one side of the body portion of the band at substantially right angles to the length thereof and bent in one direction toward one end of the band, and locking means adjacent said one end of the band for engaging one or more of said projections, said locking means and said projections permitting relative movement of said band in one direction relative to said locking means and substantially preventing relative movement thereof in the other direction, said locking means comprising a first substantially rectangular panel formed in the band and extending outwardly from one side of the band, a transverse slit for receiving one free end of the band when the device is assembled, a second substantially rectangular panel formed in the band and extending outwardly from the band in the opposite direction to the first panel, a window formed centrally of the first panel provided with a pair of transversely extending edges, a reversely bent tooth formed on one of the said window edges, a pair of transversely extending slits formed at the edges of said panel, certain of said individual teeth on the band engaging with one transverse edge of said panel, one of said teeth engaging with the reversely bent tooth on said one transverse edge of said window and one transverse edge of said depression when the device is assembled.

2. A sealing device as claimed in claim 1 wherein a portion of said tooth engaging with said reversely bent tooth on the edge of said window is concealed beneath said panel when the device is assembled.

3. A sealing device as claimed in claim 1 or 2 including penetrating means on the band for penetrating the material of the bag when the sealing device is assembled to preclude stripping the sealing device from the bag.

* * * * *